US007077073B2

(12) United States Patent
Judge

(10) Patent No.: US 7,077,073 B2
(45) Date of Patent: Jul. 18, 2006

(54) IDENTIFYING MARKER FOR END OF ROLLED PRODUCT

(76) Inventor: Daniel M. Judge, 68 Village Rd., Weston, MA (US) 02493

( * ) Notice: Subject to any disclaimer, the term of this patent is extended or adjusted under 35 U.S.C. 154(b) by 390 days.

(21) Appl. No.: 10/068,078

(22) Filed: Feb. 5, 2002

(65) Prior Publication Data

US 2003/0145778 A1 Aug. 7, 2003

(51) Int. Cl.
*G01D 13/08* (2006.01)

(52) U.S. Cl. ..... 116/299; 116/200; 116/306; 33/732; 33/733; 206/390; 206/459.5; 162/114; 162/134

(58) Field of Classification Search ..... 116/299, 116/280, 1, 200, 306, 307, 309, DIG. 1, DIG. 14; 33/1 B, 732, 733, 739, 755, 759; 162/114, 162/134, 109; 206/390, 459.5
See application file for complete search history.

(56) References Cited

U.S. PATENT DOCUMENTS

| | | | | | |
|---|---|---|---|---|---|
| 453,003 | A * | 5/1891 | Hicks | 206/390 |
| 3,050,185 | A * | 8/1962 | Crain | 206/390 |
| 3,158,938 | A | 12/1964 | Philipps et al. | |
| 3,537,578 | A * | 11/1970 | Figliuzzi | 116/200 |
| 4,076,121 | A * | 2/1978 | Clayton et al. | 206/390 |
| 4,195,787 | A * | 4/1980 | Thomason | 206/390 |
| 4,238,541 | A | 12/1980 | Burton | |
| 4,901,663 | A | 2/1990 | De Luca | |
| 5,123,343 | A | 6/1992 | Willer | |
| 5,186,988 | A * | 2/1993 | Dixon | 206/390 |
| 5,266,257 | A * | 11/1993 | Kildune | 264/224 |
| 5,753,331 | A | 5/1998 | Jeffrey | |
| 5,816,165 | A | 10/1998 | Huston | |
| 5,914,173 | A * | 6/1999 | Fishel et al. | 428/156 |
| 6,221,211 | B1 * | 4/2001 | Hollenberg et al. | 162/134 |
| 6,257,410 | B1 | 7/2001 | Ulmann et al. | |
| 6,282,807 | B1 | 9/2001 | Johnson | |

* cited by examiner

*Primary Examiner*—Diego Gutierrez
*Assistant Examiner*—Tania Courson
(74) *Attorney, Agent, or Firm*—Fish & Richardson P.C.

(57) ABSTRACT

A rolled product of contiguous separable sheets having at least one indicium to permit visual location of the end of the roll. The rolled product comprises at least a first and second contiguous separable sheet of product wound around an axis, forming a cylindrical roll, each sheet having an outer edge positioned parallel to the longitudinal axis of the cylindrical roll. At least the first and second contiguous separable sheet of product has at least one indicium that bears a predetermined relationship when the first sheet is the outer most sheet of the rolled product. The predetermined relationship is such that a discontinuity of the indicium is likely to be formed between the outer edges of sheets marked with the indicium and the portion of the indicium which lies directly beneath the outer edge of the sheets. The rolled product can include sheets of contiguous separable product having multiple indicium.

3 Claims, 2 Drawing Sheets

IDENTIFYING MARKER FOR END OF ROLLED PRODUCT

This invention relates to rolled products having contiguous separable sheets, and particularly to such rolled products that are marked with indicia.

BACKGROUND OF THE INVENTION

Rolled products having contiguous separable sheets, such as toilet paper, paper towels, plastic bags and the like, are found in virtually every home and business. It is often difficult for users of these products to quickly and easily visually locate the end sheet of the roll. For background reference is made to U.S. Pat. Nos. 6,257,410 B1; 4,238,541; 5,753,331; 6,282,807 B1; 5,816,165; 5,123,343; 4,901,663; 3,158,938.

It is an important object of the invention to provide an easily observable visual indication of the outer most end of a roll of contiguous detachable sheets.

SUMMARY OF THE INVENTION

In an aspect, the invention features a rolled product and a method of making a rolled product having contiguous separable sheets of product with an indicium for visually identifying the outermost sheet on the roll. The rolled product has at least a first and a second contiguous separable sheet of product wound around an axis, forming a cylindrical roll, each sheet having an outer edge positioned parallel to the axis. At least the first and second contiguous separable sheets of product has at least one indicium that bears a predetermined relationship when the first sheet is the outer most sheet of the rolled product. The predetermined relationship is such that a discontinuity of the indicium is likely to be formed between the outer edge of each sheet having the indicium and the portion of the indicium which lies directly beneath the outer edge of each sheet having the indicium when the sheets are formed into a cylindrical roll.

Embodiments may include one or more of the following. The rolled product of contiguous separable sheets may be wound around a cylindrical core. The indicium on the rolled product may be a continuous undulating indicium. The rolled product may have multiple indicium. The multiple indicium may also be continuous undulating indicia. The continuous undulating indicium may be out-of-phase from each other. The continuous undulating indicium may be sinusoid-shaped with a predetermined wavelength. The sheets of the rolled product may have a length equal to L and the wavelength of the sinusoid-shaped indicia may also be equal to L. The rolled product may be plastic bags, toilet paper or paper toweling. The indicium may be printed, dyed, or embossed on the sheets of product.

In another aspect of the invention, a roll of contiguous separable sheets of product has a visually perceivable mark extending continuously along the length of each of the sheets and forming a pattern such that a discountinuity is likely to be formed between the mark at any sheet edge and the portion of the mark which lies directly beneath the edge on the roll, thereby allowing the end of the rolled product to be visually located.

Embodiments may include one or more of the following. The contiguous separable sheets may be marked with a plurality of undulating visually perceivable marks extending continuously along the length of the sheets. The plurality of visually perceivable marks may be sinusoid-shaped with a wavelength equal to the length of each sheet. The sheets may be plastic bags, paper toweling or toilet paper. The mark may be printed, dyed, or embossed on the sheets of product.

Embodiments may have one or more of the following advantages. Indicia on a roll of contiguous separable sheets that permits easy visual identification of the outer most end of a roll.

Other features, objects and advantages will become apparent from the following detailed description when read in connection with the accompanying drawings in which:

DETAILED DESCRIPTION OF THE INVENTION

Figure 1:
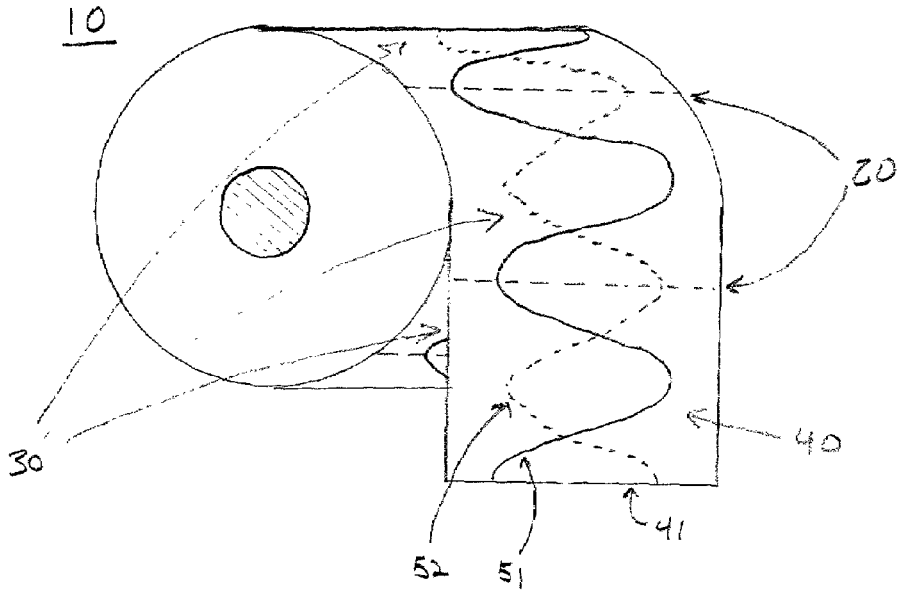
FIG. 1 is a perspective view of a roll of contiguous separable sheets of product having double sinusoid-shaped indicia for identifying the outer most end of the roll.
Figure 2:
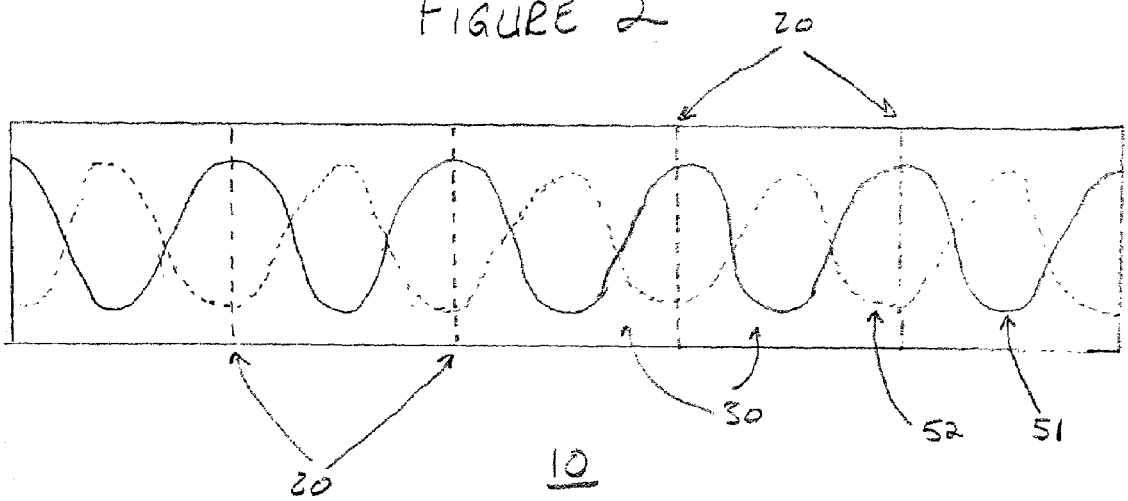
FIG. 2 is a plan view of an unrolled length of contiguously separable sheets of product with double sinusoid-shaped indicia for identifying the end of the roll.

As shown in FIGS. 1–2, a roll of product 10 with a series of perforations 20 forms a number of contiguous separable sheets of product 30 having a single end sheet 40 with an outer edge 41. Two sinusoid-shaped scrolls, 180 degrees out-of-phase from one another, 51 and 52, are printed on the surface of the contiguous sheets of product 30 and the end sheet of product 40 throughout the entire roll 10, thus forming a continuous scroll pattern on the entire roll 10. As shown in FIG. 2, the wavelength of the sinusoid-shaped scrolls 51 and 52 are shown to be equal to the length of the sheet of product 30 in this embodiment.

Figure 3:
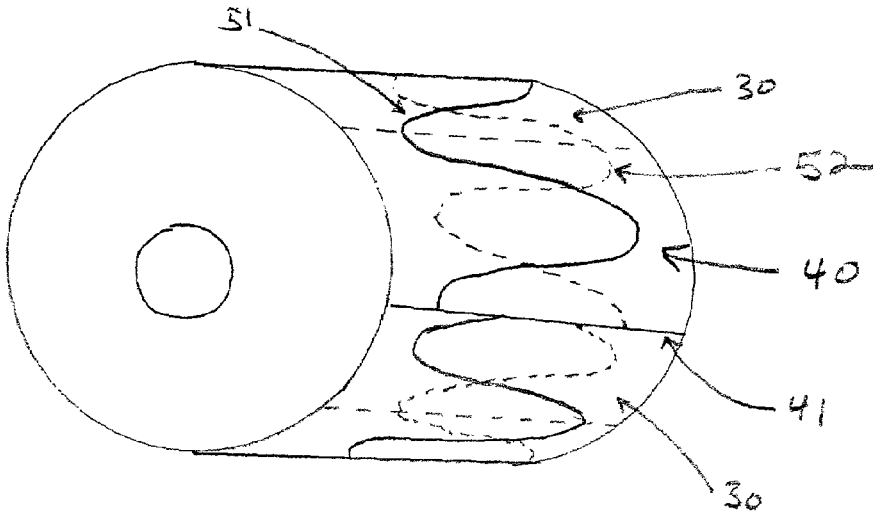
FIG. 3 is a perspective view of a roll of contiguous separable sheets of product having double sinusoid-shaped indicia indicating where the end of the roll is located.
Figure 4:
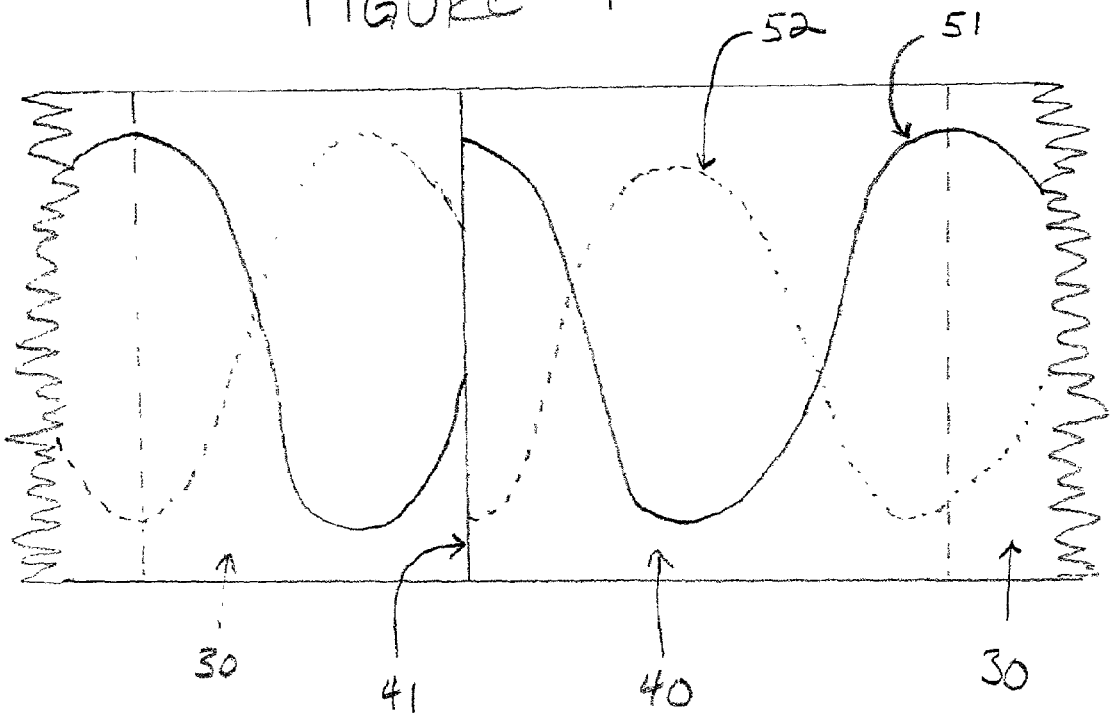
FIG. 4 is a plan view of an unrolled portion of contiguous separable sheets of product having double sinusoid-shaped indicia indicating where the end of the roll is located.

As illustrated in FIGS. 3–4, a user is able to quickly and easily visually determine the outer edge 41 of the outer most sheet of product 40 because the ends of the two sinusoid-shaped scrolls 51 and 52 will be out-of-phase with that of the next revolution of paper beneath the outer edge 41 of the end sheet of product 40.

As a user consumes the sheets of product, 30, 40, on the roll 10, the end sheet of product 40 changes. By utilizing a continuous undulating pattern printed on the entire roll 10, however, the user can visually locate the edge 41 of the end sheet of product 40 as the roll 10 is consumed by simply recognizing where there is a discontinuity in the pattern 51, 52.

While the indicia of the product may in some instances line-up with that of the next revolution of product beneath the end sheet, the indicia may be designed so as to reduce this occurrence. For example, a typical roll of toilet tissue is 4.80" in diameter, 4.5" wide, 4.0" in length, has 1000 equal-sized sheets and is spooled around a cardboard tube with an outer diameter of approximately 1.6". Using two different sinusoid-shaped scrolls, 180 degrees out-of-phase from one another, and with a wavelength equal to the length of a single sheet, the incidence of a matching continuity of scrolls would be approximately once per 332 uses based on three sheets per use.

The use of two sinusoidal scrolls, 51 and 52, depicted in FIGS. 1–4 is simply one example of the type of pattern that could be marked on the sheets 30, 40 forming the roll 10. Many other suitable indicia may be printed, dyed, embossed, or otherwise impressed on the product in order to permit easy visual identification of the last sheet on a roll. More fanciful indicia such as images of flowers, ribbons, animals, and other images may be utilized in order to increase the aesthetic value of the product while functioning to permit easy identification of the edge 41 of the end sheet 40 on the roll 10.

What is claimed is:

1. A rolled product of contiguous separable sheets, comprising:

at least a first and second contiguous separable sheet of product wound around an axis, forming a cylindrical roll, each sheet having an outer edge positioned parallel to the axis; and at least the first and second contiguous separable sheet of product having at least one indicium that bears a predetermined relationship when the first sheet is the outer most sheet of the rolled product, such that a discontinuity of the indicium is likely to be formed between the outer edge of each sheet having the indicium and the portion of the indicium which lies directly beneath the outer edge of each sheet having the indicium when the sheets are formed into a cylindrical roll, wherein at least the first and second sheet of contiguous separate sheets of product have a plurality of indicium, wherein the plurality of indicium are each a continuous undulating indicium, wherein the plurality of indicium are out-of-phase from each other, wherein each of the continuous undulating indicium are sinusoid-shaped having a predetermined wavelength, wherein the sheets are of length L and the wavelength of each of the sinusoid-shaped indicium are substantially equal to L.

2. A method, for making a roll of contiguous separable sheets of product with mark for visually locating the end of the roll, comprising:

marking the sheets with at least one visually perceivable mark extending the length of each of the sheets continuously for the entire length of said roll, the visually perceivable mark bearing a predetermined relationship between the portion of the mark at the edge of each sheet and the portion of the mark that lies directly beneath each edge when the sheets are spooled onto a roll, such that a discontinuity is likely formed between the mark at any sheet edge and the portion of the mark which lies directly beneath the edge on the roll, thereby allowing the end of the rolled product to be visually located; and spooling the sheets into a cylindrical roll, further comprising marking the sheets with a plurality of marks, wherein the plurality of marks are each sinusoid-shaped, wherein each of the sinusoid-shaped marks are out-of-phase from one another, wherein each of the said sheets have a length equal to L and each of the sinusoid-shaped marks have a wavelength substantially equal to L.

3. A roll of, contiguous separable sheets of product comprising a visually perceivable mark extending continuously along the length of each of the sheets continuously along the entire length of said roll and forming a pattern such that a discontinuity is likely formed between the mark at any sheet edge and the portion of the mark which lies directly beneath the edge on the roll, thereby allowing the end of the rolled product to be visually located, further comprising a plurality of undulating visually perceivable marks extending continuously along the length of the sheets, wherein the plurality of visually perceivable marks are sinusoid-shaped with a wavelength equal to the length of each sheet.

* * * * *